US011077387B2

(12) United States Patent
Mølgaard et al.

(10) Patent No.: US 11,077,387 B2
(45) Date of Patent: Aug. 3, 2021

(54) TEST TRACK

(71) Applicant: LEGO A/S, Billund (DK)

(72) Inventors: Rikke Høgstrup Mølgaard, Billund (DK); Søren Hansen Hinge, Billund (DK); Søren Holm, Billund (DK)

(73) Assignee: LEGO A/S, Billund (DK)

( * ) Notice: Subject to any disclaimer, the term of this patent is extended or adjusted under 35 U.S.C. 154(b) by 0 days.

(21) Appl. No.: 16/637,202

(22) PCT Filed: Aug. 16, 2018

(86) PCT No.: PCT/EP2018/072226
§ 371 (c)(1),
(2) Date: Feb. 6, 2020

(87) PCT Pub. No.: WO2019/034735
PCT Pub. Date: Feb. 21, 2019

(65) Prior Publication Data

US 2020/0360830 A1 Nov. 19, 2020

(30) Foreign Application Priority Data

Aug. 18, 2017 (DK) ..... PA 2017 70627

(51) Int. Cl.
*A63H 18/02* (2006.01)
*A63H 33/08* (2006.01)
(Continued)

(52) U.S. Cl.
CPC ..... *A63H 33/086* (2013.01); *A63H 18/026* (2013.01); *A63F 2007/3662* (2013.01); *A63H 18/08* (2013.01); *A63H 2200/00* (2013.01)

(58) Field of Classification Search
CPC ..... A63H 18/02; A63H 33/00; A63H 33/04; A63H 33/08; A63H 33/086; A63H 33/10
(Continued)

(56) References Cited

U.S. PATENT DOCUMENTS 4,403,733 A * 9/1983 Bach ..... A63H 33/062 238/10 E
5,564,962 A 10/1996 Espinosa
(Continued)

FOREIGN PATENT DOCUMENTS

EP 1184063 A2 3/2002
FR 2659242 B1 12/1992
(Continued)

OTHER PUBLICATIONS

First Technical Examination Report issued in Danish priority application No. PA 2017 70627, dated Jan. 29, 2018. (12 pp).
(Continued)

*Primary Examiner* — Kien T Nguyen
(74) *Attorney, Agent, or Firm* — Day Pitney LLP; Valeriya Svystun

(57) ABSTRACT

A test track assembly comprising a test track, the test track comprises a support structure and at least one track portion, adapted for testing a spatial structure; the test track assembly comprises at least two different interchangeable track sections, each of the at least two interchangeable track sections comprises an action track portion, each of the action track portions comprise a different geometrical track path, the action track portions adapted to provide geometric challenges to a user who tests a spatial structure on the test track, the support structure comprises a void adapted to accommodate one of the at least two interchangeable track sections in position such that the action track portion is arranged adjacently in continuation to the at least one track portion, the track portions comprises a starting point and a ending point, which are positioned opposed each end of the test track, wherein the test track assembly comprises a toy construction system, the toy construction system comprises several toy construction elements, the toy building elements comprise one or more coupling organs adapted to be inter-
(Continued)

connected to form a spatial structure, said spatial structure adapted to be tested on said test track.

12 Claims, 5 Drawing Sheets

(51) Int. Cl.
*A63F 7/36* (2006.01)
*A63H 18/08* (2006.01)

(58) Field of Classification Search
USPC ..... 446/85, 93, 94, 105, 117, 118, 120, 121
See application file for complete search history.

(56) References Cited

U.S. PATENT DOCUMENTS

| | | | | |
|---|---|---|---|---|
| 6,126,506 | A | 10/2000 | Rudy | |
| 6,340,323 | B1 | 1/2002 | Glynn | |
| 6,647,893 | B1 | 11/2003 | Fugitt et al. | |
| 9,364,769 | B2 * | 6/2016 | Kosmo ..... | A63H 33/086 |
| 2004/0082258 | A1 | 4/2004 | Kim | |
| 2006/0211331 | A1 | 9/2006 | Trageser | |
| 2011/0014844 | A1 | 1/2011 | Henson et al. | |
| 2011/0014850 | A1 | 1/2011 | Kennedy | |
| 2012/0126022 | A1 | 5/2012 | Nuttall et al. | |
| 2014/0057524 | A1 | 2/2014 | Teel et al. | |
| 2014/0273712 | A1 * | 9/2014 | Uttley ..... | A63H 33/107 446/121 |

FOREIGN PATENT DOCUMENTS

| | | | |
|---|---|---|---|
| TR | 201201916 | U | 3/2012 |
| WO | 1999030790 | A1 | 6/1999 |

OTHER PUBLICATIONS

International Search Report and Written Opinion of the International Searching Authority issued in corresponding international application No. PCT/EP2018/072226, dated Nov. 15, 2018. (11 pp).
International Preliminary Report on Patentability issued in corresponding international application No. PCT/EP2018/072226, with amended sheets of claims and specification, dated Jul. 23, 2019. (24 pp).

* cited by examiner

TEST TRACK

CROSS-REFERENCE TO RELATED APPLICATIONS

This application is a U.S. National Stage of International Application No. PCT/EP2018/072226, filed on 16 Aug. 2018 and published on 21 Feb. 2019, as WO 2019/034735 A1, which claims the benefit of priority to Danish Patent Application No. DK PA201770627, filed on 18 Aug. 2017. The content of each of the above referenced patent applications is incorporated herein by reference in its entirety for any purpose whatsoever.

The present invention relates to a test track assembly comprising a test track.

The test track comprises a support structure and at least one track portion, adapted for testing a spatial structure; the test track assembly comprises at least two different interchangeable track sections, each of the at least two interchangeable track sections comprises an action track portion, each of the action track portions comprises a different geometrical track path, the action track portions adapted to provide geometric challenges to a user who tests a spatial structure on the test track, the support structure comprises a void adapted to accommodate one of the at least two interchangeable track sections in position, such that the action track portion is arranged adjacent in continuation to the at least one track portion, the track portions comprises a starting point and an ending point, which are positioned opposed each end of the test track.

DESCRIPTION OF RELATED ART

It is well known having a track comprising a variety of challenges, and thereby challenging the user.

The technique disclosed in the Turkish utility model no. 201201916 U relates to a modular structure for playing mini golf. The track may be altered by moving the track-portions comprising obstacles.

Similar technique is disclosed in the French patent no. 2659242, which discloses an invention relating to a device for playing mini golf on a table. The device comprises a support 5 to receive the basic track, in two parts 1,2. A rotary circular plate 11 has the eighteen obstacles 13 on the two faces, thus forming the difficulties of the course.

However, in many cases it is desirable to further increase the scope for variations.

Additionally, it would be desirable to increase the understanding of physics for younger children and to some degree improve their ability to master physics and related challenges.

SUMMARY OF THE INVENTION

It is therefore an object of the invention to increase the variety of options.

This is solved in part according to the features listed in the characterizing part of claim 1.

Hereby, the options of variations are increased significantly.

Additionally, a user may analyse and access the result of a test performed on the test track, and afterwards adapt a spatial structure, such as a vehicle, e.g. in form of changing width, length, weight, center of gravity etc. to perform a specific course of track successfully.

Further advantageous features are provided in the dependent claims.

In an embodiment, the at least one track portion are fixedly mounted to the support structure of the test track, and the at least one track portion comprises a sloping surface adapted to provide a ramp for the spatial structure.

In an embodiment, the test track comprises a support structure adapted to surround the test track, said support structure comprises a first end wall and a second end wall, and the track portions extend consecutively in the longitudinal direction from said first end wall towards said second end wall, and the at least one track portion is sloping from the first end wall downwards towards the second end wall.

In an embodiment, the at least two interchangeable track sections are positioned at the second end wall, at the end of the track.

In an embodiment, the track portion comprises a launch box, adapted to provide a starting point for the spatial structure.

In an embodiment, the support structure further comprises a first side wall, a second side wall and a ceiling panel, and the outer surfaces of the support structure walls and panel comprise a cladding made from plastic materials, Kerrock or Corion and the cladding comprises indentations, the indentations are positioned adapted to illustrate a modular constructed test track.

In an embodiment, the test track comprises technical equipment, such as screens and sensors.

Hereby is achieved that the screens may monitor a performed test in slow motion. A user may analyse and access the information received by the technical equipment at the measurement zone.

In an embodiment, the test track comprises a light sensor, which is positioned at the interchangeable track section in the proximity of the action track portion and the at least one sloping test track.

In an embodiment, the one or more toy building elements comprise(s) at least two different types of coupling organs, such as coupling studs and complementary coupling means.

Another aspect of the invention relates to a method for using a test track assembly, wherein the method comprises the steps of: constructing a spatial structure of toy construction elements, testing the spatial structure on the test track, analyzing the outcome of the performed test, reconstructing and adapting the spatial structure to the course of track of the action track portion.

In an embodiment, the method further comprises the steps of: analyzing technical information received, such as speed data, slow motion pictures.

In an embodiment, the method further comprises the steps of: repeating reconstructing the spatial structure until the action track portion has been performed successfully.

In an embodiment, the method further comprises the steps of: replacing the interchangeable track section in the test track support structure by another interchangeable track section comprising an action track portion comprising a different geometric shape adapted to provide another course of track.

It should be emphasized that the term "comprises/comprising/comprised of" when used in this specification is taken to specify the presence of stated features, integers, steps or components but does not preclude the presence or addition of one or more other features, integers, steps, components or groups thereof.

BRIEF DESCRIPTION OF THE DRAWINGS

In the following, the invention will be described in greater detail with reference to embodiments shown by the enclosed figures. It should be emphasized that the embodiments shown are used for example purposes only and should not be used to limit the scope of the invention.

DETAILED DESCRIPTION OF THE EMBODIMENTS

It is to be noted that the figures and the above description have shown the example embodiments in a simple and schematic manner. The internal electronic, structural and mechanical details have not been shown since the person skilled in the art should be familiar with these details and they would just unnecessarily complicate this description.

The present invention relates to a test track assembly 1 comprising a test track 10 and a spatial structure 24, which is constructed by toy construction elements 22. The test track 10 comprises consecutive track portions for testing the spatial structure 24 following the path of the track portions.

In that context it may be convenient to define that the term "longitudinal direction" is meant to refer to a direction which runs along the length of the track portions.

The term "spatial structure" is meant to refer to any structure that is designed and adapted for the purpose of following the path of the test track, e.g. such as a vehicle for test-driving a track.

Figure 1:
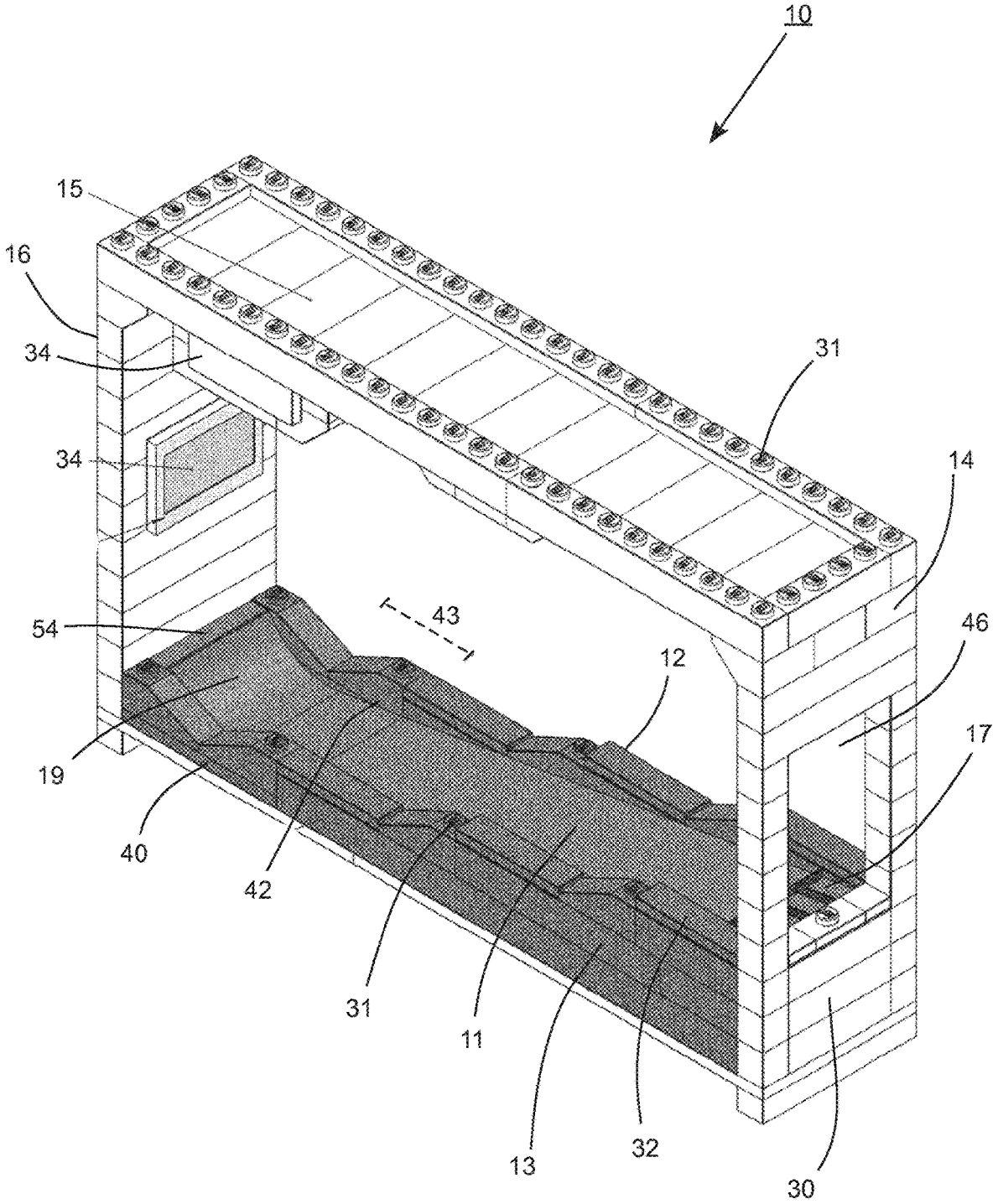
FIG. 1 shows a three dimensional view of a test track.
Figure 2:
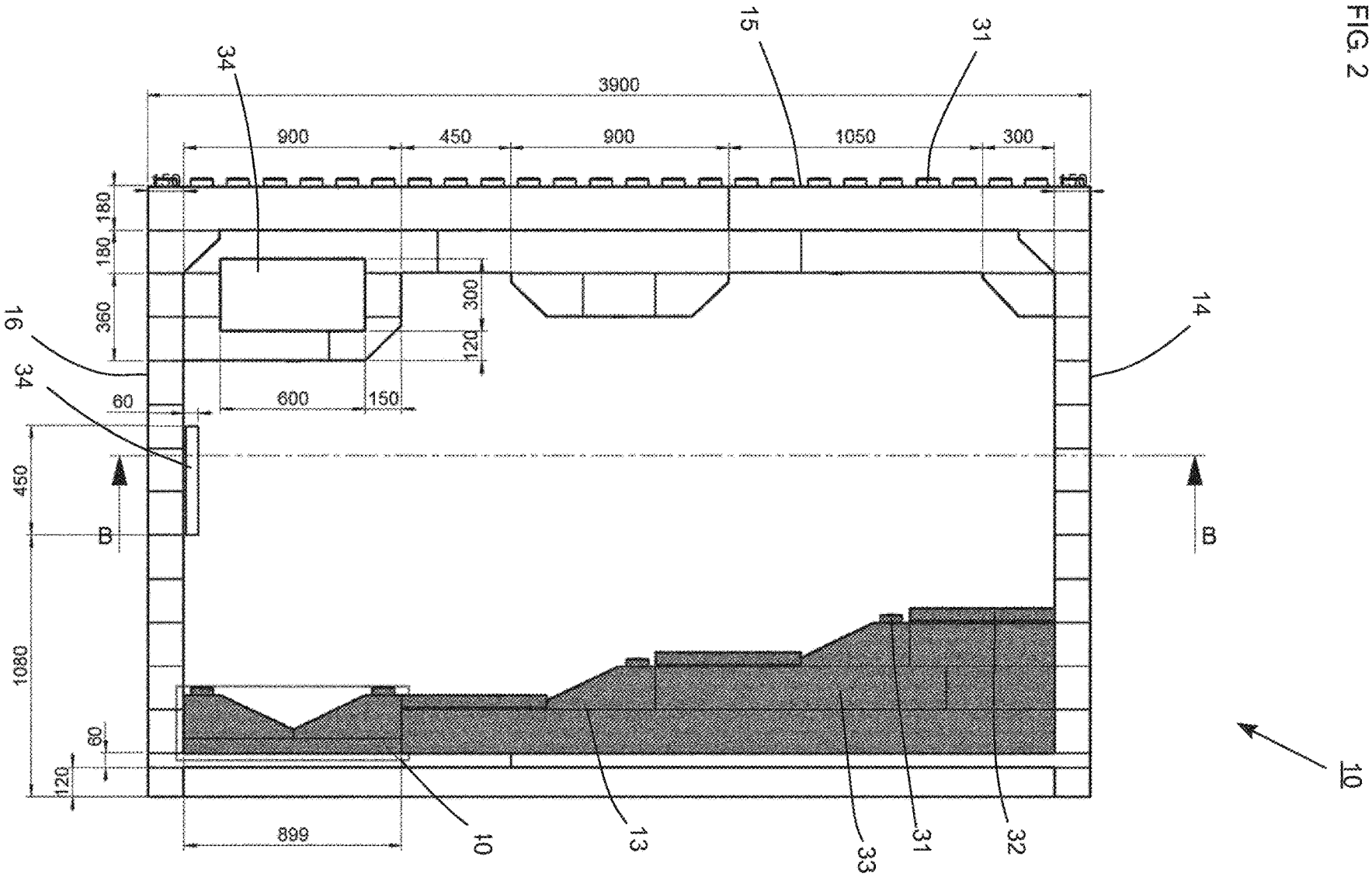
FIG. 2 shows a side view of a test track.
Figure 3:
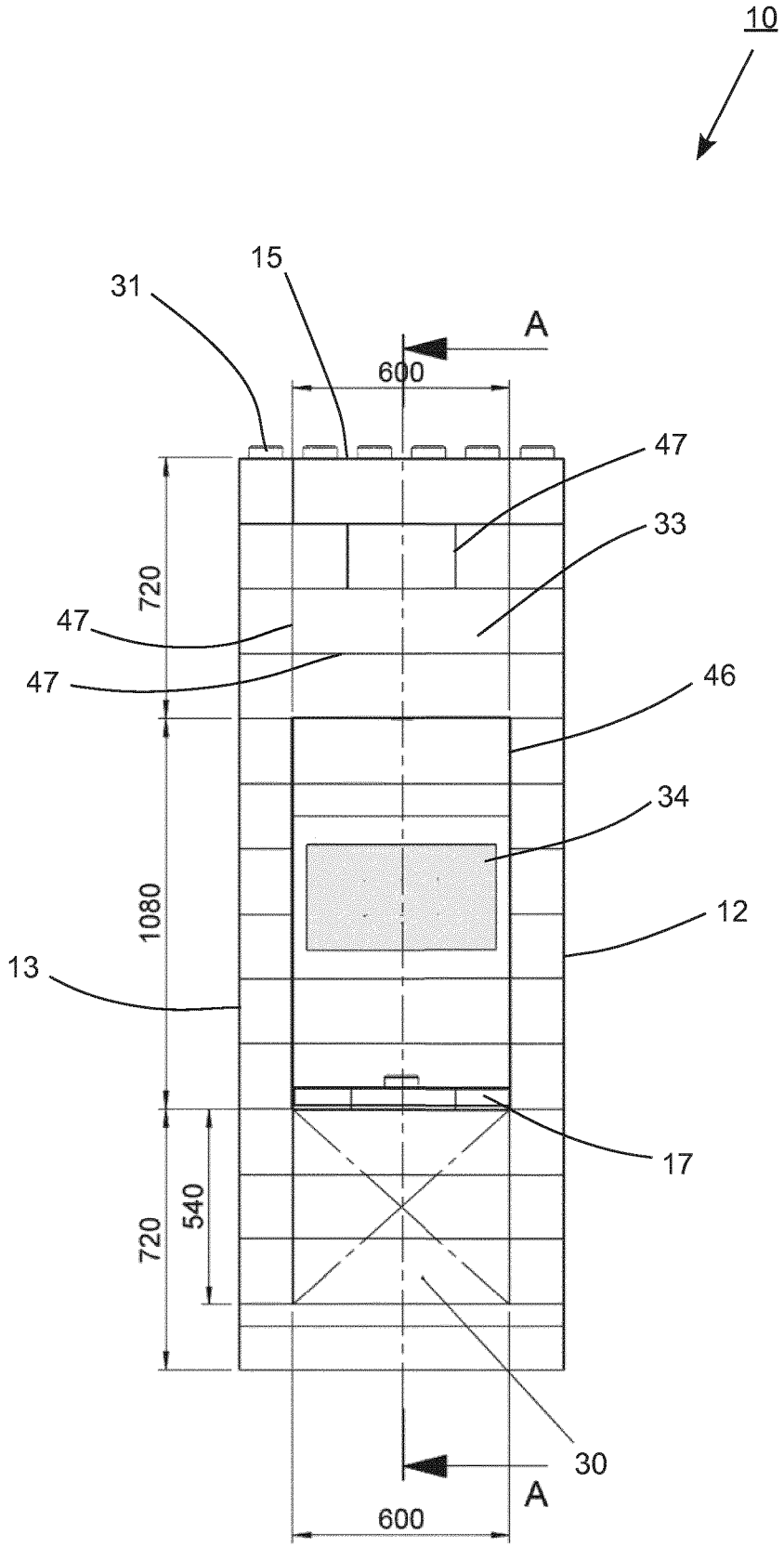
FIG. 3 shows an end view of a test track.

FIGS. 1-3 show different views of one embodiment of a test track 10.

FIG. 1 shows a three dimensional view of a test track 10.

The test track 10 comprises two consecutive track portions 11,19. The track portions 11,19 are surrounded by a support structure. The support structure comprises a first side wall 12, a first end wall 14, a second side wall 13, a second end wall 16 and a ceiling panel 15.

The top of the first and second end wall 14,16 are structurally connected to the ceiling panel 15. The first and second side walls 12, 13 extend horizontally between the first end wall 14 and the second end wall 16. Vertically, the first and second side walls 12,13 of the support structure extend to or slightly above the upper surface of the track portions 11,19 to allow a user to access the track portions, without the risk of a spatial structure 24 leaving the test track unintendedly, when testing the test track.

The track portions 11,19 extend consecutively in its longitudinal direction from the first end wall 14 towards the second end wall 16.

The test track 10 comprises launch boxes 17 positioned adjacent to each other in a transverse direction of the longitudinal direction. The launch boxes 17 are positioned at the track portion 11 juxtaposed the first end wall 14.

The track portion 11 is sloping downwards towards the second end wall 16. The track portion 11 could therefore be called sloping track portion 11. The sloping track portion 11 is adapted to provide a uniform and comparable starting point for a spatial structure 24 comprising toy construction elements 22, such as a vehicle.

FIG. 1 shows that—in direct extension (in the longitudinal direction of the track, and in the direction from the first end wall 14 towards the second end wall 16) of the track portion 11—an action track portion 19 is arranged.

The test track 10 of the test track assembly 1 comprises a void adapted to accommodate an interchangeable track section 40.

The interchangeable track section 40 comprises a sub part of the first and second side walls 12,13 and the action track portion 19. When the interchangeable track section 40 is mounted within the void of the support structure at the test track 10, the action track portion 19 is a consecutive extension of the sloping track portion 11 in the longitudinal direction of the test track 10.

The void, configured to accommodate the interchangeable track section 40, is positioned adjacent the second end wall 16.

The action track portion 19 of the interchangeable track section 40 comprises a variable geometrical track path. In the embodiment shown in FIG. 1 the action track portion 19 comprises a curved uphill, ending at a horizontal platform 54.

The test track 10 comprises a measurement zone 43 and technical equipment, such as screens and sensors. One screen 34 is posited at the end wall 16.

Another screen 34 is in the shown embodiment mounted beneath the sealing panel 15.

The test track 10 comprises a light sensor 42. The light sensor 42 is positioned in the first side wall 12 of the test track 10. The light sensor 42 is positioned in the first side wall 12 of the test track 10 at an interchangeable track section 40. The light sensor 42 is adapted to measure the speed of the spatial structure 24 when it passes the location on the track where light sensor is arranged. The light sensor 42 is positioned nearby or at the transition between the sloping track portion 11 and the action track portion 19.

In general, the optimal position may depend on the geometrics of a unique course of track of an action track portion 19.

The technical equipment in the measurement zone 43 may comprise other types of sensors than a light sensor 42, including cameras, speed sensors etc.

In either case, the sensor or sensors may be connected to one or more of the screens 34, such that information obtained by the sensor (or sensors) may be displayed on one or both of the screens. The sensor(s) and the screen(s) may be electronically connected via a processor (not shown). The processor may be configured for processing data received from the sensor(s).

The support structure of the test track 10 comprises a through-going aperture 46, which is positioned in the first end wall 14. The through going aperture 46 is adapted to allow a user to access the launch boxes 17 and to view the screen 34 positioned on opposed positioned second end wall 16.

A user, which test-drives a spatial structure 24, in the form of a vehicle, on the test track may analyse and access the information received by the technical equipment at the measurement zone 43, and then afterwards adapt the spatial structure 24, e.g. in form of changing width, length, weight, center of gravity etc. to a specific course of a track. The screens 34 may monitor a performed test in slow motion, thus providing the user with detailed information of the test results.

After a redesign of the spatial structure, the user may then perform a new test drive.

The first end wall 14 comprises a service hatch 30, allowing access for service. The hatch 30 closes by magnets.

FIG. 2 shows a side view of the test track 10 shown in FIG. 1.

The support structure of the test track 10 comprises a first side wall 13, a first end wall 14 and a second end wall 16 and a ceiling panel 15.

The top of the first end wall 14 and the second end wall 16 are structurally connected to the ceiling panel 15 which is positioned above the track portions, 11,19.

In general, the support structure may be constructed by wooden material. The support structure comprises a cladding, which is made from plastic material, e.g. a plastic such as materials known under the names Kerrock or Corion.

The cladding thus constitutes an exterior surface of the support structure.

The surface of the cladding comprises indentations 47. The indentations 47 are elongate, and are positioned within a three dimensional square grid—both vertically and horizontally—in distances correspond to standard units of a module size in three mutually perpendicular directions. The indentations 47 formed in the surface of the cladding of the track test 10 is adapted to give the illusion that the test track 10 has been modular constructed using enlarged toy construction system elements (building blocks) 33.

In FIG. 2 it is illustrated that the total length of the test track 10 is 3900 mm. The length of the interchangeable track section 40 is 899 mm. the height of one standard size of a module corresponding the distance between two horizontal indentations 47 is 180 mm.

The ceiling panel 15 comprises protrusions 31 shaped as cylindrically shaped coupling organs. At various locations along the sidewalls 12, 13, and on an upper surface thereof similar protrusions 31, shaped as cylindrically shaped coupling organs, are also formed. Other portions of the upper surface of the sidewalls 12, 13 may show flat, tile shaped structure 32. The flat, tile shaped structure 32 do not need to be independent parts, but may preferably be visually divided from the sidewall 12, 13 below by horizontal elongate indentations in the cladding.

In the embodiment shown in FIGS. 1-3, the test track 10 comprises screens 34. One screen is arranged at the second end wall 16 1080 mm above the floor, and another screen is hanging vertically from the ceiling panel 15, mounted on a downwardly protruding part of the ceiling panel 15.

The entire interchangeable portion 40 can be removed from the support structure and replaced by another interchangeable portion 40. The interchangeable portion 40 is held in place by bolts and electronics are plugged in with a single connector.

FIG. 3 shows an end view of a test track.

The height of the test track 10 is 2520 mm. On top of the ceiling panel 15 the test track 10 comprises identically shaped protrusions 31.

The through going aperture 46 is positioned in the first end wall 14 at 720 mm above the floor. The through going aperture 46 is adapted to give a user access to the launch box 17 and to view the screen positioned on opposed positioned end wall.

The indentations 47 are arranged—within a three dimensional square grid—both vertically and horizontally in distances correspond to standard module sizes in three consecutive directions. Thereby, the indentations 47 are adapted to give the illusion that the test track 10 has been modular constructed using enlarged toy construction system elements 33.

The first end wall 14 comprises a service hatch 30, allowing access for service. The hatch closes by magnets.

Figure 4:
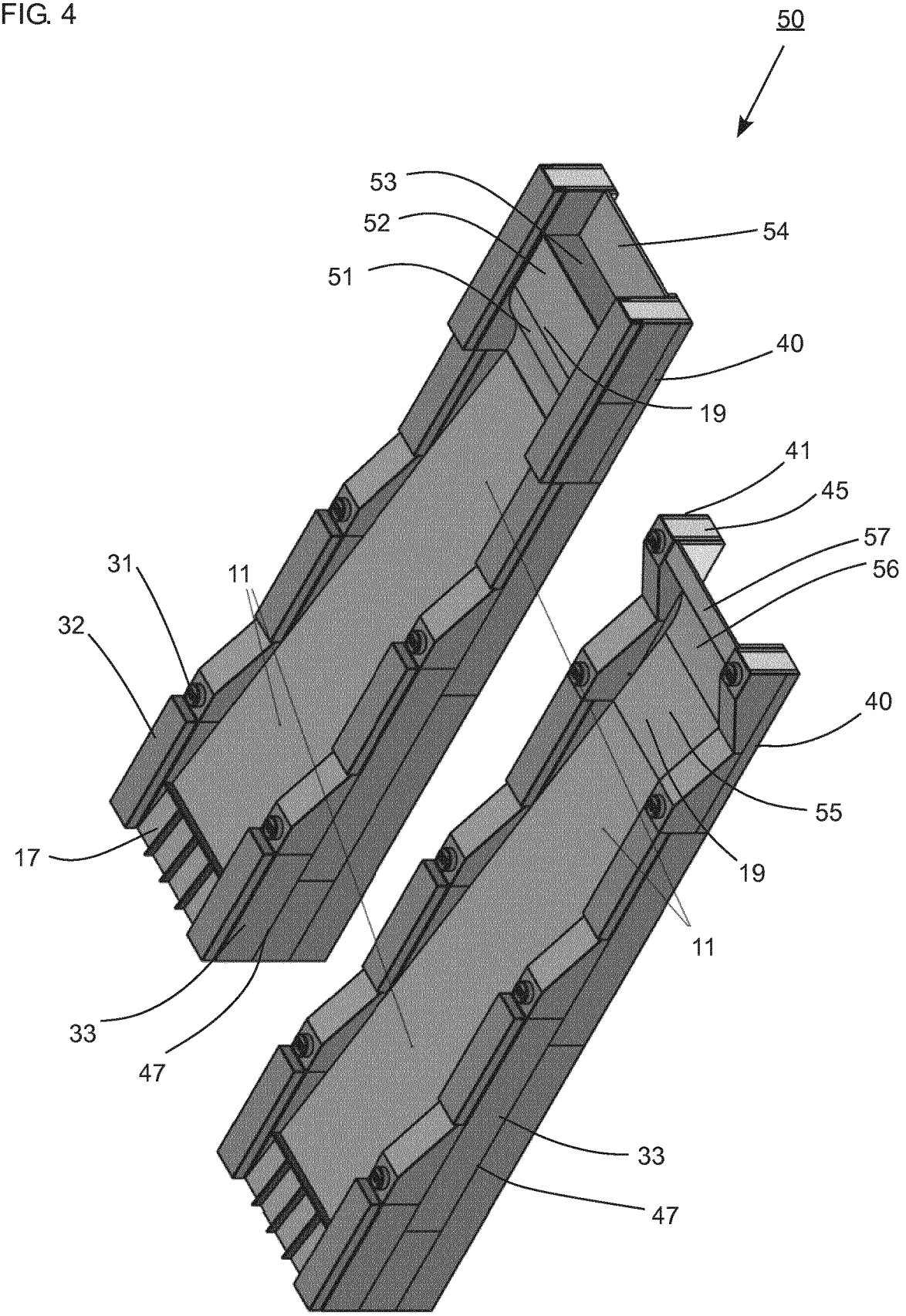
FIG. 4 shows a part of two test tracks and an interchangeable track section.

FIG. 4 shows a sub part of two test tracks 10, showing the sloping track portion 11 and the interchangeable track section 19.

A test track assembly 1 comprises at least two action track portions 19, which comprises different geometrical tracks.

In FIG. 4 two geometrical different action track portions 19 are illustrated.

Each of the action track portions 19 in a test track assembly 1 comprises a different geometrical track path. The action track portions 19 are adapted to provide new challenges to a user of the test track 10.

The sloping track portion 11 is a fixed part of the test track 10. The sloping track portion 11 comprises a uniform slope being adapted to provide a ramp providing velocity to a vehicle launched from a launch box 17.

The interchangeable track section 40 is positioned at the second end wall 16 of the support structure, at the end of the track.

The test track 10, in the embodiments shown in FIG. 4, comprises of four juxtaposed launch boxes 17. Several vehicles may be tested simultaneously. In general, the launch boxes 17 may be featured with automatics (not shown), adapted to launch the spatial structures 24 in the form of vehicles, or launching of a vehicle may simply be done by removing an obstacle (not shown), allowing the vehicle to start rolling down and accelerate along the length of the sloping track portion 11.

The interchangeable track section 40 comprises varying geometrics. One of the illustrated interchangeable track sections 40 comprises—in the longitudinal direction—an S-shaped uphill curved part 51 followed by a horizontal platform 52. After the horizontal platform 52, in the driving direction, follows a vertical section 53 and then the interchangeable track section 19 is finished by a horizontal section 54.

The challenge for the user, by testing this specific geometrically shaped action track portion 19, may be to construct a vehicle that fulfills the requirements, defined by the geometrics of the interchangeable track section 19, to allow the vehicle to obtain sufficient velocity to pass the S-shaped uphill and park the vehicle on the horizontal platform 52, and additionally avoiding too much speed thus avoiding the vehicle driving into the free fall part of the track (53, 54) and unintendedly ending at the finishing horizontal section 54.

The other illustrated interchangeable track section 40 shown in FIG. 4 (shown on the left hand side of FIG. 4), comprises an action track portion 19 which comprises, in the longitudinal direction, i.e. the driving direction, a steeper sloping ramp 55 followed by a parabolic or C-curved uphill part 56 and finished off by a narrow horizontal platform 57.

The challenge for a user of the test track assembly 1 is to construct a spatial structure 24 in the form of a vehicle according to the geometric and nature of the track in order to succeed the challenge given by the interchangeable track section 40.

The method for using a test track assembly 1 comprises the steps of:

- constructing a spatial structure 24 (vehicle) comprising toy construction elements 22,
- test-driving the vehicle/spatial structure 24 on the test track 10,
- analyzing the result of the test-drive,
- reconstructing and/or adapting the vehicle/spatial structure 24 to the course of track of the action track portion 19.

Additionally, the method further comprises the steps of:

- analyzing the technical information received, such as speed data, slow motion pictures,
- redesigning the vehicle/spatial structure 24,
- test-driving, These steps are repeated until the challenge given by the action track portion 19 has been performed successfully.

Then, the method may further comprise the step of replacing the action track portion 19 by another action track portion 19 comprising a geometric shape adapted to provide another course of track.

The method may also comprise the steps of positioning the vehicle/spatial structure 24 in a launch box 17, adapted to provide a uniform start position for the vehicle/spatial structure 24, such that the vehicle/spatial structure 24 is started under similar and comparable conditions.

The screens 34 may monitor a performed test-drive in slow motion. A user may analyse and access the information received by the technical equipment at the measurement zone 43, and then afterwards adapt the spatial structure 23, e.g. in form of changing width, length, weight, center of gravity etc. to a specific course of a track.

The user may then perform a new test drive.

The shape of the action track portion 19 can be varied into many different designs.

Figure 5:
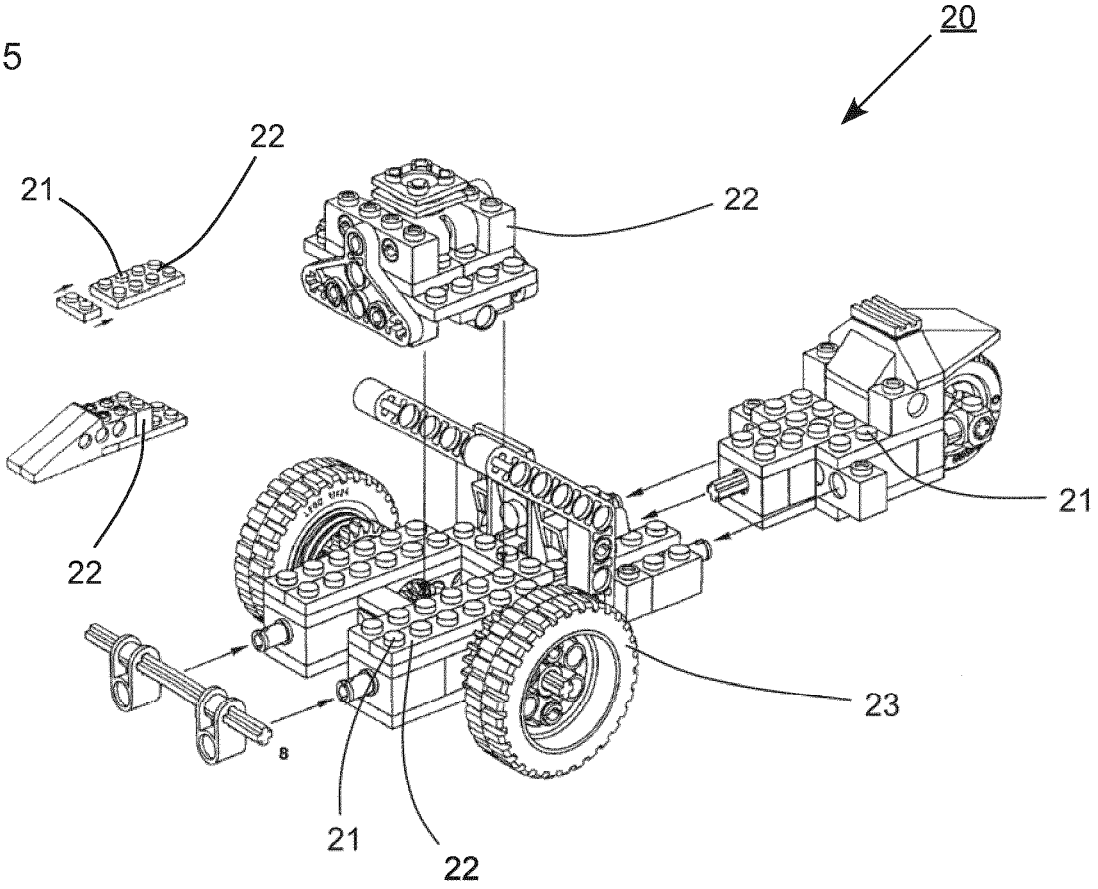
FIG. 5 shows a toy construction system.

FIG. 5 shows a toy construction system 20 which comprises several toy construction elements 22.

The toy building elements 22 comprises one or more coupling organs 21 and the toy construction elements 22 are adapted to be interconnected to form a spatial structure 24, the spatial structure comprising wheels 23, such as a vehicle.

The toy building elements 22 comprise at least two different types of coupling organs 21, such as coupling studs and complementary stud receiving coupling means.

Figure 6:
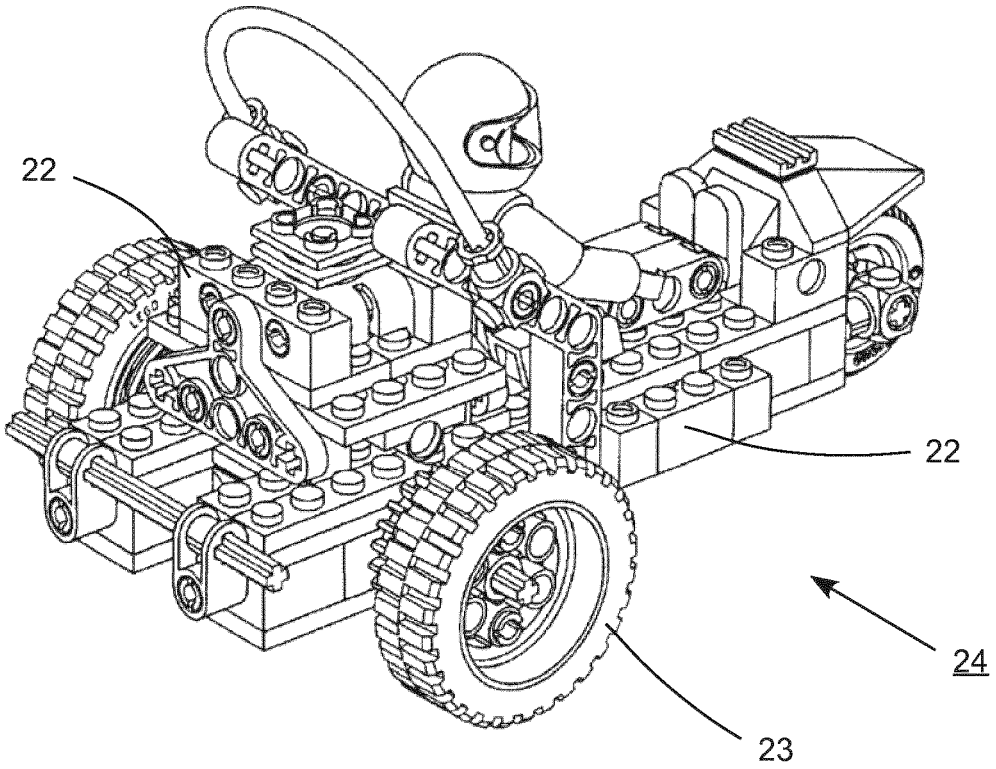
FIG. 6 shows a spatial structure constructed by toy construction elements.

FIG. 6 shows a spatial structure 24 constructed by toy construction elements 22.

The illustrated spatial structure 24 comprises the shape of a three wheeled vehicle.

In general, the coupling organs 21 may be such as coupling studs and stud-receiving recesses.

The figures and the description disclose a test track assembly 1 comprising a test track 10, the test track 10 comprises a support structure and at least one track portion 11,19, adapted for testing a vehicle; the test track assembly 1 comprises at least two different interchangeable track sections 40, each of the at least two interchangeable track sections 40 comprises an action track portion 19, each of the action track portions 19 comprises a different geometrical track path, the action track portions 19 adapted to provide geometric challenges to a user who tests a vehicle on the test track, the support structure comprises a void adapted to accommodate one of the at least two interchangeable track sections 40 in position, such that the action track portion 19 is arranged adjacent in continuation to the at least one track portion 11 (sloping track portion 11), the track portions 11,19 comprises a starting point and a ending point, which are positioned opposed each end of the test track 10, wherein the test track assembly 1 comprises a toy construction system, the toy construction system comprises several toy building/construction elements 22, the toy building elements 22 comprise one or more coupling organs 21 adapted to be interconnected to form a vehicle, said vehicle adapted to be tested on said test track.

The invention claimed is:

1. A test track assembly comprising:

a test track the test track comprising a support structure and at least one track portion-adapted for testing a spatial structure;

the test track assembly comprising at least two different interchangeable track sections, each of the at least two interchangeable track sections comprising an action track portion, each of the action track portions comprising a different geometrical track path, the action track portions adapted to provide geometric challenges to a user who tests a spatial structure on the test track;

wherein the support structure comprises a void adapted to accommodate one of the at least two interchangeable track sections in position, such that the action track portion is arranged adjacent to, and in continuation to the at least one track portion, the track portions comprising a starting point and the action track portion comprising an ending point, which are positioned opposed each end of the test track;

wherein the test track assembly comprises a toy construction system, the toy construction system comprising several toy construction elements, wherein the toy construction elements each comprises one or more coupling organs adapted to be interconnected to form a spatial structure, said spatial structure adapted to be tested on said test track; and wherein the support structure is adapted to surround the test track, said support structure comprising a first end wall and a second end wall, and wherein the track portions extend consecutively in the longitudinal direction from said first end wall towards said second end wall, and the at least one track portion is sloping from the first end wall downwards towards the second end wall.

2. A test track assembly according to claim 1, wherein the at least one track portion is fixedly mounted to the support structure of the test track, and the at least one track portion comprises a sloping surface adapted to provide a ramp for the spatial structure.

3. A test track assembly according to claim 1, wherein the at least two interchangeable track sections are positioned at the second end wall, at the end of the track.

4. A test track assembly according to claim 1, wherein the track portion comprises a launch box, adapted to provide a starting point for the spatial structure.

5. A test track assembly according to claim 1, wherein the support structure further comprises a first side wall, a second side wall and a ceiling panel, and the outer surfaces of the support structure walls and panel comprise a cladding, and the cladding comprises indentations, the indentations are positioned adapted to illustrate a modular constructed test track.

6. A test track assembly according to claim 1, wherein the test track comprises technical equipment, including screens and sensors.

7. A test track assembly according to claim 1, wherein the test track comprises a light sensor, which is positioned at the interchangeable track section in the proximity of the action track portion and the at least one test track.

8. A test track assembly according to claim 1, wherein the one or more toy construction elements each comprises at least two different types of coupling organs, including coupling studs and complementary coupling means.

9. A method for using a test track assembly according to claim 1, wherein the method comprises the steps of:

constructing a spatial structure of toy construction elements, testing the spatial structure on the test track, analyzing the outcome of the performed test, and reconstructing and adapting the spatial structure to the course of track of the action track portion.

10. A method according to claim 9, wherein the method further comprises the steps of:

analyzing technical information received, the technical information comprising one or more of speed data and slow motion pictures.

11. A method according to claim 9, wherein the method further comprises the steps of:

repeating reconstructing the spatial structure until the action track portion has been performed successfully.

12. A method according to claim 9, wherein the method further comprises the step of:

replacing the interchangeable track section in the test track support structure by another interchangeable track section comprising an action track portion comprising a different geometric shape and adapted to provide another course of track.

* * * * *